US006304044B1

(12) United States Patent
Tagami et al.

(10) Patent No.: US 6,304,044 B1
(45) Date of Patent: Oct. 16, 2001

(54) COLOR DISPLAY TUBE DEVICE

(75) Inventors: Etsuiji Tagami, Osaka; Katsuyo Iwasaki; Toshihiko Shichijyo, both of Hyogo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/613,324

(22) Filed: Jul. 11, 2000

(30) Foreign Application Priority Data

Jul. 12, 1999 (JP) ..... 11-197070

(51) Int. Cl.[7] ..... H01J 29/76
(52) U.S. Cl. ..... 315/364; 315/370
(58) Field of Search ..... 315/364, 369, 315/370, 399

(56) References Cited

U.S. PATENT DOCUMENTS 5,070,280 * 12/1991 Okuyama et al. ..... 315/368.11

FOREIGN PATENT DOCUMENTS 63-94542 4/1988 (JP) .

* cited by examiner

*Primary Examiner*—David Vu
(74) *Attorney, Agent, or Firm*—Merchant & Gould P.C.

(57) ABSTRACT

A color display tube device includes a composite correction circuit having a series circuit of a first reactor coil and a first four-pole coil and a series circuit of a second reactor coil with a polarity opposite to that of the first reactor coil and a second four-pole coil, the two series circuits being connected in parallel, and a vertical control coil for applying a magnetic bias that changes in synchronization with a vertical deflection current to the first and second reactor coils. The composite correction circuit is connected in series to horizontal deflection coils. In the color display tube device using an in-line self-convergence system, it is made possible to correct a PQH mis-convergence and reduce pincushion distortion at the left and right occurring before correction by a monitor set while preventing deterioration of the focus performance.

4 Claims, 9 Drawing Sheets

COLOR DISPLAY TUBE DEVICE

FIELD OF THE INVENTION

The present invention relates to a color display tube device used in a television or a computer display, and more specifically to a configuration of a deflection circuit for improving convergence.

BACKGROUND OF THE INVENTION

In recent years, an increasing number of flat panel color display tubes have been developed. There has been a problem that pincushion distortion at the top, bottom, left and right are likely to increase when a deflection yoke for a conventional color display tube with a curved panel is used in a color display tube with a flat panel. Accordingly, efforts have been made to solve these problems.

In the problems mentioned-above, the pincushion distortion at the top and bottom is corrected generally by means of adding magnets to the above and below part of the deflection yoke at the screen side. This utilizes the effect that strong pincushion magnetic fields generated by the magnets draw electron beams in a vertical axis direction. Consequently, with respect to mis-convergence on the vertical axis (YH), a pincushion-shaped residual mis-convergence is likely to occur in a self-convergence system, as shown in FIG. 10. Along with the development of flat panels, there is a tendency to increase the pincushion distortion at the top and bottom. Therefore, the magnetic field generated by the magnet is further strengthened for correcting this distortion, thus increasing the YH pincushion-shaped residual mis-convergence even more.

In order to solve such a problem, four-pole coils for generating a four-pole magnetic field and YH correction circuits are added to the deflection yoke on the electron gun side, so that a vertical deflection current is supplied to them, thereby performing a YH correction. The principle of this YH correction is as follows. Before electron beams enter a main magnetic field generated by the deflection yoke, the four-pole magnetic field generated by the four-pole coils separates side beams away from each other, thereby canceling the effect that the side beams are shifted closer to each other after the electron beams enter the main magnetic field. This is synchronized with vertical deflection so as to generate the four-pole magnetic field with a strength in proportion to the vertical deflection current. In order to generate the four-pole magnetic field that has the same polarity regardless of a deflection polarity, a rectifier circuit of a diode is added.

On the other hand, the pincushion distortion at the left and right is corrected by means of a pincushion distortion correction circuit in the monitor set.

Next, in order to improve a focus performance, it is considered that a pincushion magnetic field of a horizontal deflection magnetic field is weakened so as to reduce the distortion of shapes of electron beam spots or to reduce the difference in shapes of spots of three electron beams. However, this method has the problem that a barrel-shaped residual mis-convergence of a vertical line mis-convergence on the horizontal axis (XH) occurs in a self-convergence system of in-line color display tubes, as shown in FIG. 11.

In order to solve this problem, as shown in FIG. 12, the invention described in JP 63-94542 A uses a circuit in which a four-pole coil 51 provided to a deflection yoke on the electron gun side is laid out as a bridge over four coils 52, 53, 54 and 55 of a saturable reactor. A horizontal deflection current is sent to this circuit so that the four-pole magnetic field that has the same polarity regardless of a polarity of the deflection current is generated with a strength being in proportion to the horizontal deflection current, thereby correcting beam spots. Since the XH is made variable at the same time, this method also can achieve an XH correction. In this circuit, the saturable reactor reduces inductance of the coils 52 and 55 in FIG. 12 during a positive half cycle (left deflection) and reduces inductance of the coils 53 and 54 during a negative half cycle (right deflection). Therefore, in any case, a horizontal deflection current runs through the four-pole coil 51 in the downward direction in the figure, generating a magnetic field having the same polarity. Such a relatively simple configuration can correct the XH.

However, as described above, when magnetic fields generated by the magnets for correcting the pincushion distortion at the top and bottom are strengthened, the increase in a YH correction amount is caused. If this correction of the increased amount is performed by means of a conventional YH correction, the YH correction amounts at the corners are larger than that on the vertical axis. Therefore, there has been a problem in that, even when the YH on the vertical axis is corrected optimally, a red beam right pattern of vertical line mis-convergence between side beams (PQH) occurs at the corners, as shown in FIG. 13.

In order not to increase the YH correction amount, it can be considered that barrel distortion of a vertical magnetic field of the deflection yoke is strengthened so as to reduce the pincushion-shaped residual mis-convergence. However, since this method leads to an increase in the pincushion distortion at the top and bottom again, there has been no alternative but to adopt a setting compromising with a PQH red beam right pattern.

On the other hand, with respect to the increase in the pincushion distortion at the left and right along with the development of flat panels, there has been no means but to increase a correction amount of the pincushion distortion of a monitor set, leading to an inevitable increase in power consumption accompanied by the increase in the correction amount.

SUMMARY OF THE INVENTION

It is an object of the present invention to solve the problems described above and to provide a color display tube device which can correct a PQH mis-convergence and reduces pincushion distortion at the left and right occurring before correction by a monitor set while preventing a deterioration of a focus performance in an in-line self-convergence system.

A color display tube device in accordance with the present invention includes a composite correction circuit having a series circuit of a first reactor coil and a first four-pole coil and a series circuit of a second reactor coil with a polarity opposite to that of the first reactor coil and a second four-pole coil, the two series circuits being connected in parallel, and a vertical control coil for applying a magnetic bias that changes in synchronization with a vertical deflection current to the first and second reactor coils. The composite correction circuit is connected in series to horizontal deflection coils.

With this configuration, the magnetic bias applied to the reactor coils can be changed in synchronization with the vertical deflection current, the first and second reactor coils can be saturated alternately according to a degree of deflection, and the four-pole coils to be operated can be switched. Thus, without increasing the pincushion distortion at the top and bottom, an XH mis-convergence and a PQH mis-convergence can be corrected. Furthermore, pincushion distortion at the left and right occurring before a monitor set correction can be reduced.

In the above configuration, it is preferable that the color display tube device further includes a magnet for applying a constant magnetic bias to the first and second reactor coils, and the first and second reactor coils, the vertical control coil and the magnet constitute a saturable reactor. During a positive half cycle of a horizontal deflection current, the first reactor coil is saturated so that a four-pole magnetic field generated by the first four-pole coil becomes dominant, and during a negative half cycle of the horizontal deflection current, the second reactor coil is saturated so that a four-pole magnetic field generated by the second four-pole coil becomes dominant.

Further preferably, the color display tube device in accordance with the present invention is configured as in the following, so as to include a composite correction circuit having a series circuit of a first reactor coil and a first four-pole coil and a series circuit of a second reactor coil with a polarity opposite to that of the first reactor coil and a second four-pole coil, the two series circuits being connected in parallel, and a vertical control coil for applying a magnetic bias that changes in synchronization with a vertical deflection current to the first and second reactor coils. The composite correction circuit is connected in series to horizontal deflection coils. Furthermore, a magnet for applying a constant magnetic bias to the first and second reactor coils is provided, wherein the first and second reactor coils, the vertical control coil and the magnet constitute a saturable reactor. During a positive half cycle of a horizontal deflection current, the first reactor coil is saturated so that a four-pole magnetic field generated by the first four-pole coil becomes dominant. During a negative half cycle of the horizontal deflection current, the second reactor coil is saturated so that a four-pole magnetic field generated by the second four-pole coil becomes dominant. In this manner, an amount of a vertical line mis-convergence between side beams on a horizontal axis in a screen is changed so as to obtain a desired convergence. At the same time, a positively rectified vertical deflection current is supplied to the vertical control coil, so that a strength of the four-pole magnetic fields generated by the first and second four-pole coils is changed in synchronization with the current, and an amount of a vertical line mis-convergence between side beams at corners of a screen is changed, thereby obtaining a desired convergence independently from an amount of change of the vertical line mis-convergence between side beams on the horizontal axis in the screen, as well as correcting pincushion distortion in left and right parts of the screen.

Also, it is preferable that the magnetic flux density of the magnet of the saturable reactor is variable structurally, making it possible to perform a fine adjustment of a correction amount of the vertical line mis-convergence between side beams on the horizontal axis in the screen.

DETAILED DESCRIPTION OF THE INVENTION

The following is a description of embodiments adopting the present invention into a 46 cm (19 inch) flat panel color display tube device with 100° deflection, with reference to the accompanying drawings.

First Embodiment

Figure 1:
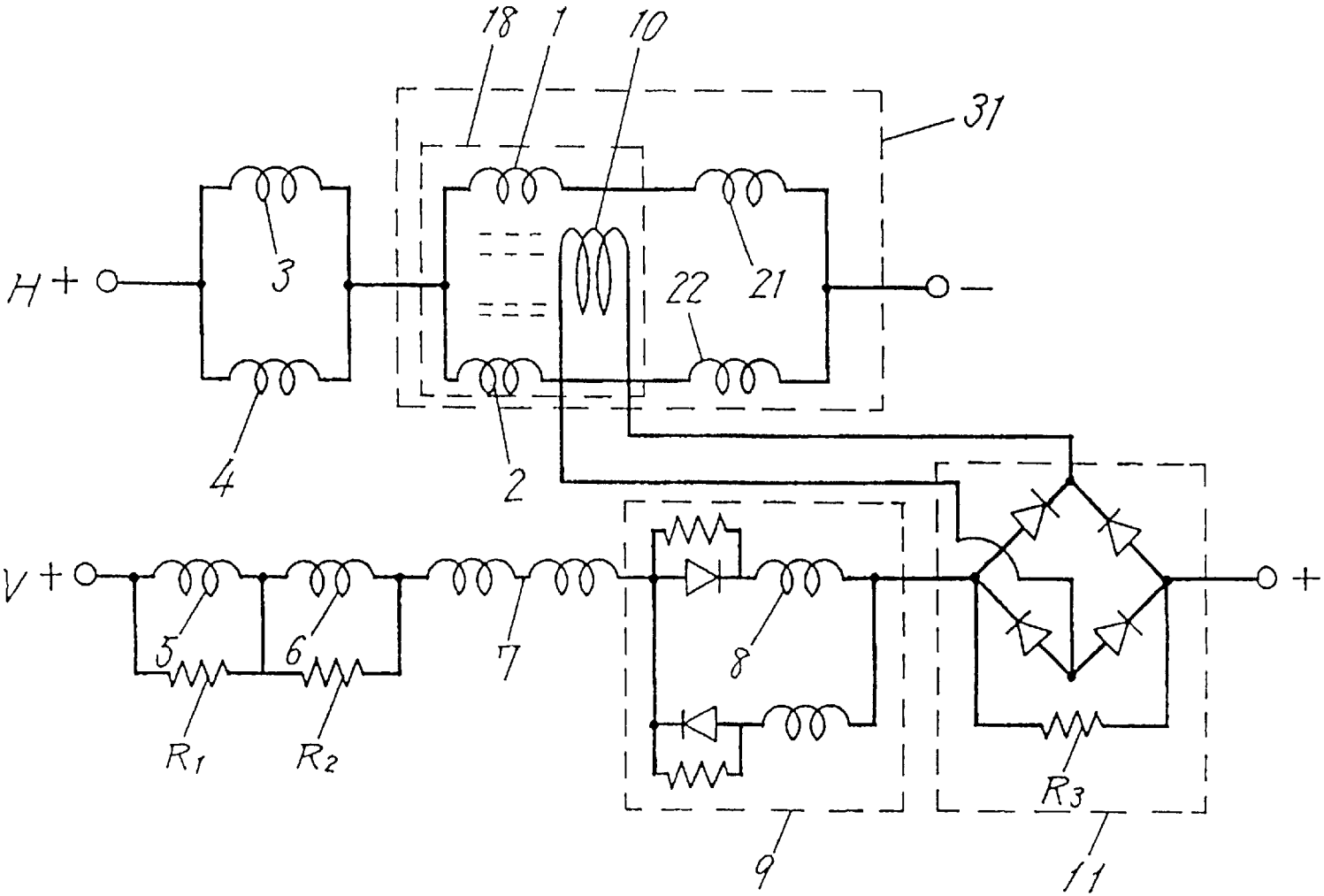
FIG. 1 is a connection diagram of horizontal deflection coils and vertical deflection coils, which constitute an important part of a color display tube device of an embodiment of the present invention.

FIG. 1 is a circuit diagram of a deflection yoke and a peripheral part thereof in a color display tube device in accordance with a first embodiment of the present invention.

Horizontal deflection coils 3 and 4 denote upper and lower coils that are connected in parallel to each other. A reactor coil 1 and a four-pole coil 21 are connected in series, and a reactor coil 2 and a four-pole coil 22 are connected in series to each other. These two series circuit of reactor coil and four-pole coil are connected in parallel, constituting a composite correction circuit 31. The composite correction circuit 31 is connected in series to the horizontal deflection coils 3 and 4. The total inductance of the horizontal deflection coils 3 and 4 and the composite correction circuit 31 is approximately 90 $\mu$H.

Figure 3:
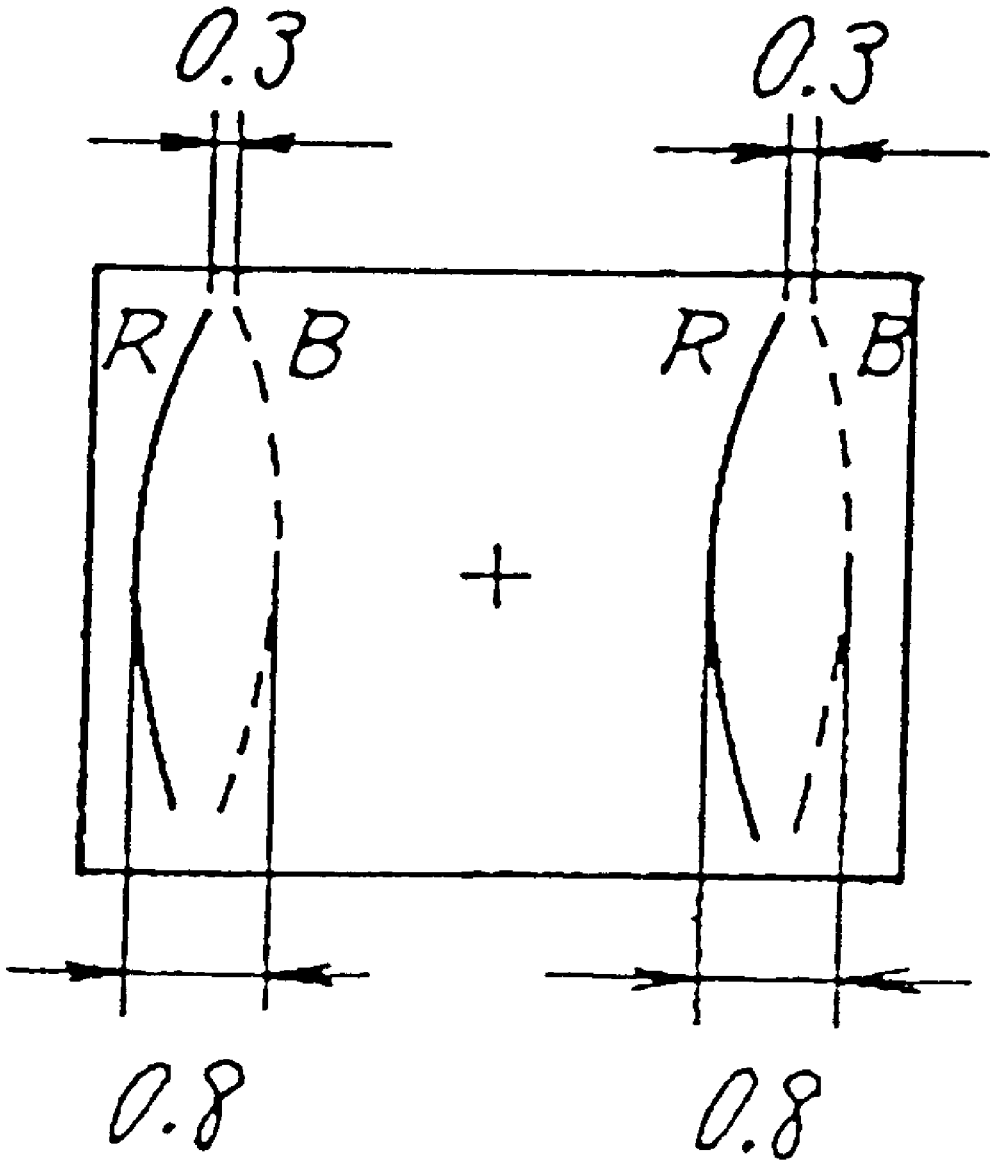
FIG. 3 shows vertical line RB mis-convergence patterns at the left and right when an XH correction is not performed.

The magnetic fields of the horizontal deflection coils 3 and 4 provide a slightly weakened pincushion magnetic field for a self-convergence in order to prevent a deterioration of focus performance. Therefore, as shown in FIG. 3, an XH barrel-shaped residual mis-convergence of 0.8 mm occurs when an XH correction is not performed. Also, with respect to vertical line RB mis-convergence at the corners, a PQH red beam right pattern of 0.5 mm is superimposed, resulting in a red beam left pattern of 0.3 mm.

Vertical deflection coils 5 and 6 denote left and right coils that are connected in series, and connected in parallel to damping resistors $R_1$ and $R_2$ respectively. The vertical deflection coils 5 and 6 are connected in series to coma aberration correction coils 7, a YH correction circuit 9 accompanied by four-pole coils 8 for a YH correction mentioned above and a vertical rectifier circuit 11 accompanied by a vertical control coil 10. The vertical control coil 10 and the reactor coils 1 and 2 constitute a saturable reactor 18. The total inductance of the vertical deflection coils 5 and 6, the coma aberration correction coils 7, the YH correction circuit 9 and the vertical rectifier circuit 11 is 5 mH.

In FIG. 1, for example, resistor $R_1=R_2=220\ \Omega$, $R_3=5.6\ \Omega$, and each diode is a Schottky diode.

Figure 2:
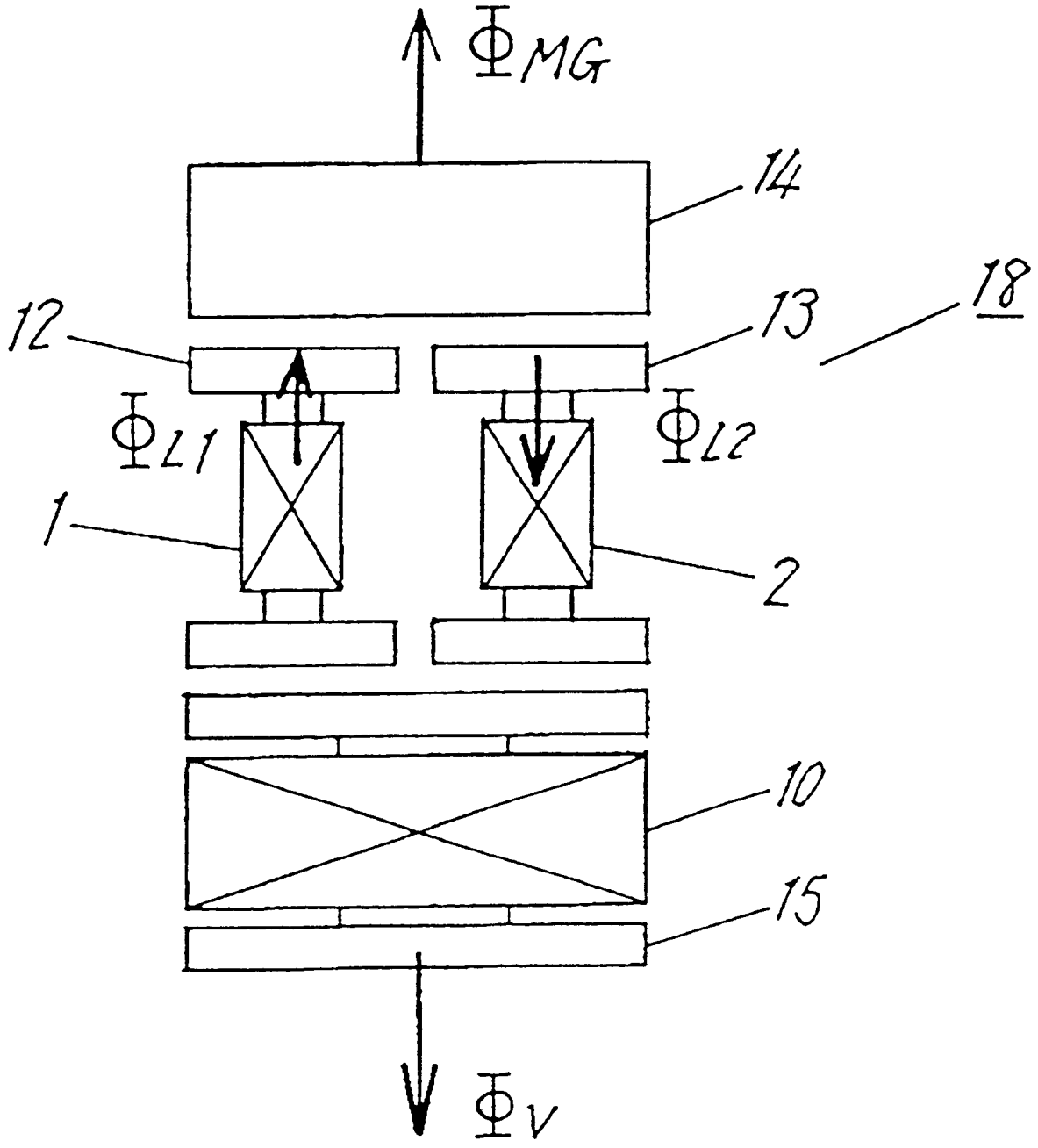
FIG. 2 is a schematic view illustrating a structure of a saturable reactor in FIG. 1.

FIG. 2 shows the saturable reactor 18 for correcting XH, PQH and left and right distortions including the reactor coils 1 and 2. The reactor coils 1 and 2 are both formed by coiling a bundle of three copper wires around thin rod-like ferrite cores 12 and 13 for ten times. The bundle of three copper wires has a wire diameter $\phi$ of 0.2 mm, and the rod-like ferrite cores 12 and 13 are 10 mm long and have disk-like collars with a diameter of 6 mm at the tips thereof. The reactor coils 1 and 2 are arranged side by side and generate magnetic fields with opposite polarity. Adjacent to one side of the collars of the rod-like ferrite cores 12 and 13, a substantially elliptic cylindrical magnet 14 with a minor axis of 8 mm×a major axis of 14 mm×a height of 24 mm for applying a magnetic bias is disposed with its south pole facing the collar. The vertical control coil 10 is arranged adjacent to the side of the other collars of the ferrite cores 12 and 13. The vertical control coil 10 is formed by coiling a copper wire having a wire diameter $\phi$ of 0.36 mm for 130 times around a ferrite core 15 having substantially cylindrical large collars at both ends.

Figure 4:
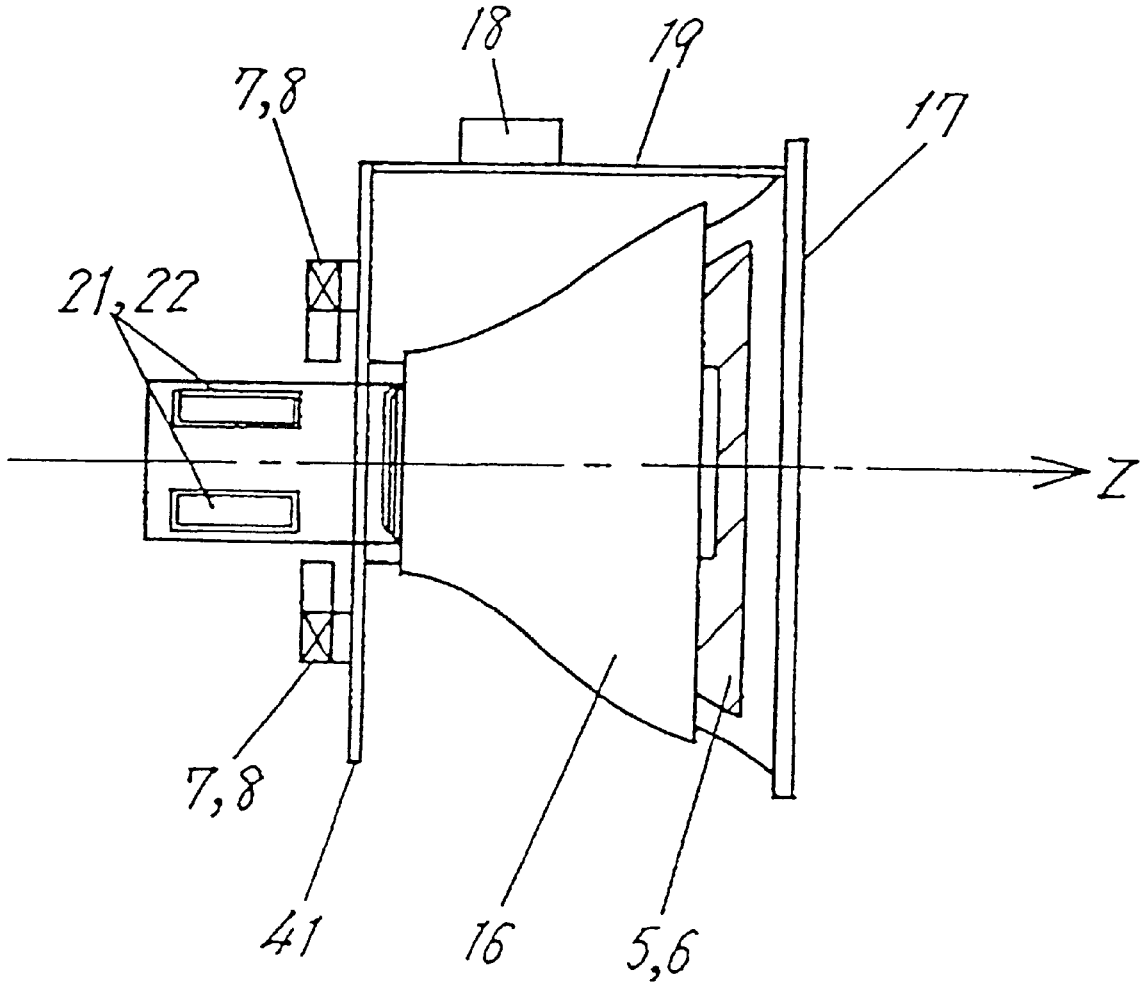
FIG. 4 is a side view of a deflection yoke constituting the color display tube device in the embodiment of the present invention.
Figure 5:
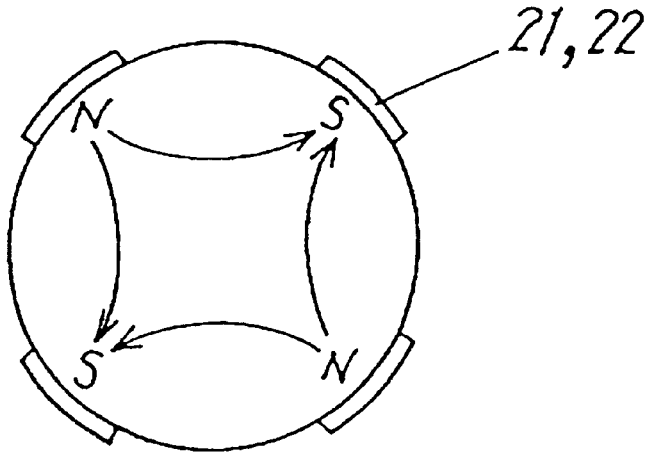
FIG. 5 is a drawing for describing a four-pole magnetic field generated by four-pole coils in the embodiment of the present invention.

FIG. 4 shows a side elevation of the deflection yoke in accordance with the present invention. The deflection yoke includes horizontal deflection coils (not shown in the figure), an insulation frame 17, the vertical deflection coils 5 and 6 and a ferrite core 16. Two four-pole coils, each of which includes a set of four air-cored coils, are arranged in a cylindrical portion on a neck side (electron gun side). One four-pole coil corresponds to a four-pole coil 21 shown in FIG. 1, and the other corresponds to a four-pole coil 22. As shown in FIG. 5, the four coils 21 and 22 are arranged at substantially equal angular intervals around a tube axis. Both of the coils 21 and 22 have the same shape and are formed by coiling a bundle of three copper wires for ten times. The bundle of three copper wires has a wire diameter $\phi$ of 0.2 mm. The four-pole coils 21 and 22 are illustrated as if there was only one set of four coils in the figure, because they are coiled up concentrically. In addition, the four-pole coils 21 and 22 generate magnetic fields with opposite polarity to each other when current with the same direction flows in the circuit shown in FIG. 1.

In FIG. 4, on a plate 41 provided in the rear side of the ferrite core 16, the coma aberration correction coils 7 and 8 are provided so that the cylindrical portion is interposed therebetween from above and below. A printed board 19 bridging over the insulation frame 17 and the plate 41 is a terminal board for laying out the deflection yoke. A saturable reactor 18 is disposed on the printed board 19. The saturable reactor 18 is the one shown in FIG. 2.

The following is a description of principles of an XH correction, a PQH correction and a left and right pincushion distortion correction, in accordance with the above configuration including the saturable reactor of the present invention.

First, the principle of the XH correction in accordance with the present invention is described.

When the vertical deflection current $I_V=0$, the vertical control coil 10 of the vertical rectifier circuit 11 does not operate. When the horizontal deflection current $I_H$ is in a positive half cycle, i.e., left deflection, the reactor coil 1 generates a magnetic flux $\Phi L1$ in the upward direction in FIG. 2 (hereinafter, referred to as "+ direction"), and the reactor coil 2 generates a magnetic flux $\Phi L2$ in the downward direction in this figure (hereinafter, referred to as "− direction"). The magnet 14 provides a magnetic flux $\Phi MG$ in the + direction.

As the horizontal deflection current $I_H$ increases, the magnetic flux $\Phi L1$ of the reactor coil 1 comes to a saturation state. Accordingly, the inductance L1 of the reactor coil 1 decreases, while the inductance L2 of the reactor coil 2 increases. As a result, the horizontal deflection current $I_H$, which has a relatively high frequency component, mainly flows into the reactor coil 1 that has a lower inductance between those of the reactor coils 1 and 2. Consequently, the four-pole coil 21 operates so that the four-pole magnetic field generated by the four-pole coil 21 becomes dominant. The four-pole coil 21 generates the four-pole magnetic field shown in FIG. 5, thereby correcting an XH barrel-shaped residual mis-convergence at the left side of the screen.

On the other hand, when the horizontal deflection current is in a negative half cycle, i.e., right deflection, the reactor coil 2 is saturated, and the four-pole coil 22 operates mainly so as to generate the magnetic field with the same polarity as that generated by the four-pole coil 21, thereby correcting an XH barrel-shaped residual mis-convergence at the right side of the screen.

Figure 6:
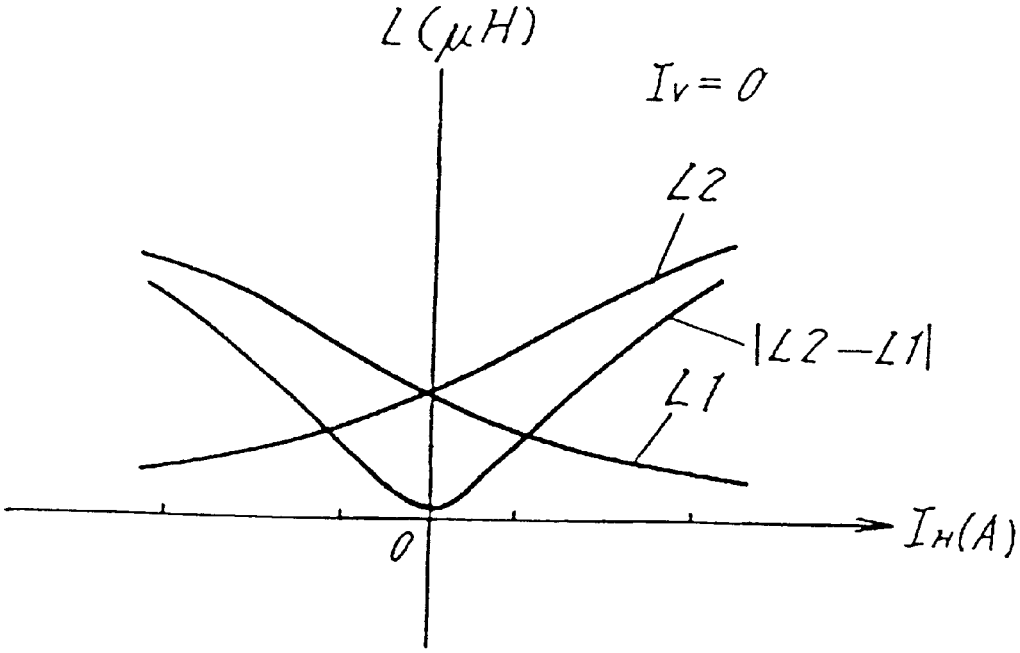
FIG. 6 is a graph showing the relationship between a horizontal deflection current and inductances L1 and L2 of coils constituting the saturable reactor when a vertical deflection current is 0.

FIG. 6 is a graph showing the relationship between the horizontal deflection current $I_H$ (the axis of abscissa) and inductances L1 and L2 of the reactor coils 1 and 2 (the axis of ordinate) when the vertical deflection current $I_V=0$. When the horizontal deflection current $I_H=0$, the relationship is L1=L2. When the horizontal deflection current $I_H$ is in a positive half cycle, L1 decreases and L2 increases along with the increase in the horizontal deflection current $I_H$. The difference between L1 and L2 ($|L2-L1|$) indicates a strength of the four-pole magnetic field for correcting the XH. As the horizontal deflection current $I_H$ increases, the strength of the four-pole magnetic field for correcting the XH also increases, leading to an increase in the XH correction amount. Therefore, the vertical line RB mis-convergence on the horizontal axis at the left side of the screen is corrected. On the other hand, during a negative half cycle, the vertical line RB mis-convergence on the horizontal axis at the right side of the screen is corrected.

Second, the principle of the PQH correction in accordance with the present invention is described.

Figure 7:
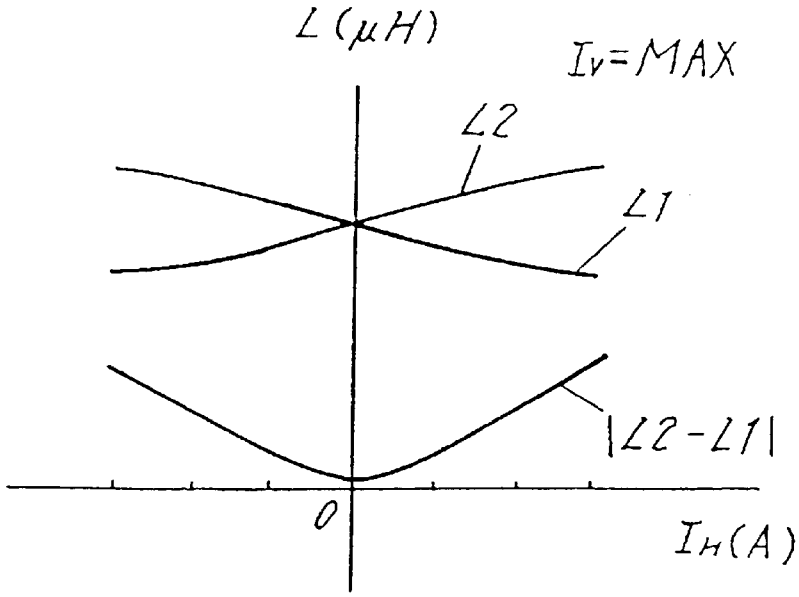
FIG. 7 is a graph showing the relationship between a horizontal deflection current and inductances L1 and L2 of coils constituting the saturable reactor when a vertical deflection current is maximum.

When the vertical deflection current $I_V$ is maximum in a positive half cycle, in other words, when a horizontal line is drawn at the top of the screen by a horizontal deflection, the magnetic flux $\Phi_V$ in the −direction with a polarity opposite to the magnet 14 is generated in the vertical control coil 10 as shown in FIG. 2. FIG. 7 is a graph showing the relationship between the horizontal deflection current $I_H$ (the horizontal axis) and inductances L1 and L2 of the reactor coils 1 and 2 (the vertical axis) at this time. Both L1 and L2 are larger than those at the time the vertical deflection current $I_V=0$ (shown in FIG. 6). The reason is that the magnetic flux is unlikely to be saturated because the magnetic flux $\Phi_V$ of the vertical control coil 10 is in the direction that cancels magnetic flux $\Phi MG$ generated by the magnet. Thus, the difference between L1 and L2 ($|L2-L1|$) also decreases, resulting in a four-pole magnetic field weaker than that at the time of the XH correction on the horizontal axis.

As described above, with respect to the vertical line RB mis-convergence at the corners of the screen, the PQH red beam right pattern of 0.5 mm is superimposed on the XH barrel-shaped residual mis-convergence of 0.8 mm so that the red beam left pattern of 0.3 mm remains, as shown in FIG. 3. Thus, with respect to the vertical fine mis-convergence on the horizontal line at the upper part of the screen, since the PQH red beam right pattern is superimposed at the corners, the necessary correction amount is less than that necessary for the XH correction on the horizontal axis. As described above, according to the present invention, at the time of a correction of the vertical line mis-convergence on the horizontal line at the upper part of the screen, the four-pole magnetic field becomes weaker than that at the time of the XH correction on the horizontal axis due to the magnetic flux generated by the vertical control coil 10, thus avoiding an overcorrection of the PQH red beam right pattern.

When the vertical deflection current $I_V$is in a negative half cycle, the PQH red beam right pattern also can be corrected in a similar manner. The reason is that the vertical control coil 10 generates a magnetic flux with the same polarity as that during a positive half cycle of the vertical deflection current $I_V$ because it is provided with an electric current via the vertical rectifier circuit 11 using diodes as described above. As a result, the four pole magnetic field with the same polarity is generated, thereby correcting the PQH red beam right pattern in a similar manner.

Third, the principle of the left and right pincushion distortion correction in accordance with the present invention is described.

Figure 8:
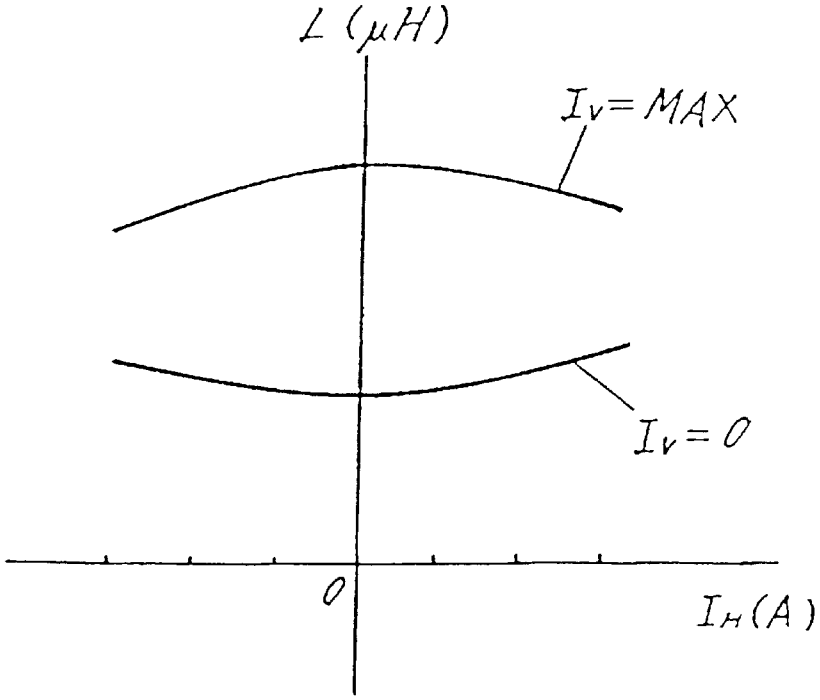
FIG. 8 is a graph showing the relationship between a horizontal deflection current and total inductance of the saturable reactor.

FIG. 8 is a graph showing the relationship between the horizontal deflection current $I_H$ and total inductance L of the composite correction circuit 31 under the conditions that the vertical deflection current $I_V$=0 and that the vertical deflection current is maximum in a positive half cycle, namely $I_V$=MAX. Focusing on the condition that the absolute value of the horizontal deflection current is maximum, the larger the absolute value of the vertical deflection current is, the larger L is. This means that since the magnetic flux $\Phi_V$ of the vertical control coil 10 is in such direction that it cancels magnetic flux ΦMG generated by the magnet 14, the saturation characteristics are weakened and the inductances L1 and L2 of the reactor coils 1 and 2 become larger, whereby the total inductance also becomes larger.

With this effect, the total inductance of the horizontal deflection systems is larger at the time of the deflection to the corners than at the time of the deflection to the left or right end on the horizontal axis. Therefore, deflection sensitivity to the corners becomes relatively lower, thus reducing the left and right pincushion distortion.

Second Embodiment

In the second embodiment of the present invention, the magnetic flux density of the magnet 14 of the saturable reactor 18 shown in FIG. 2 is made variable structurally, making it possible to perform a fine adjustment of a correction amount of a vertical line mis-convergence between side beams on the horizontal axis in the screen.

Figure 9:
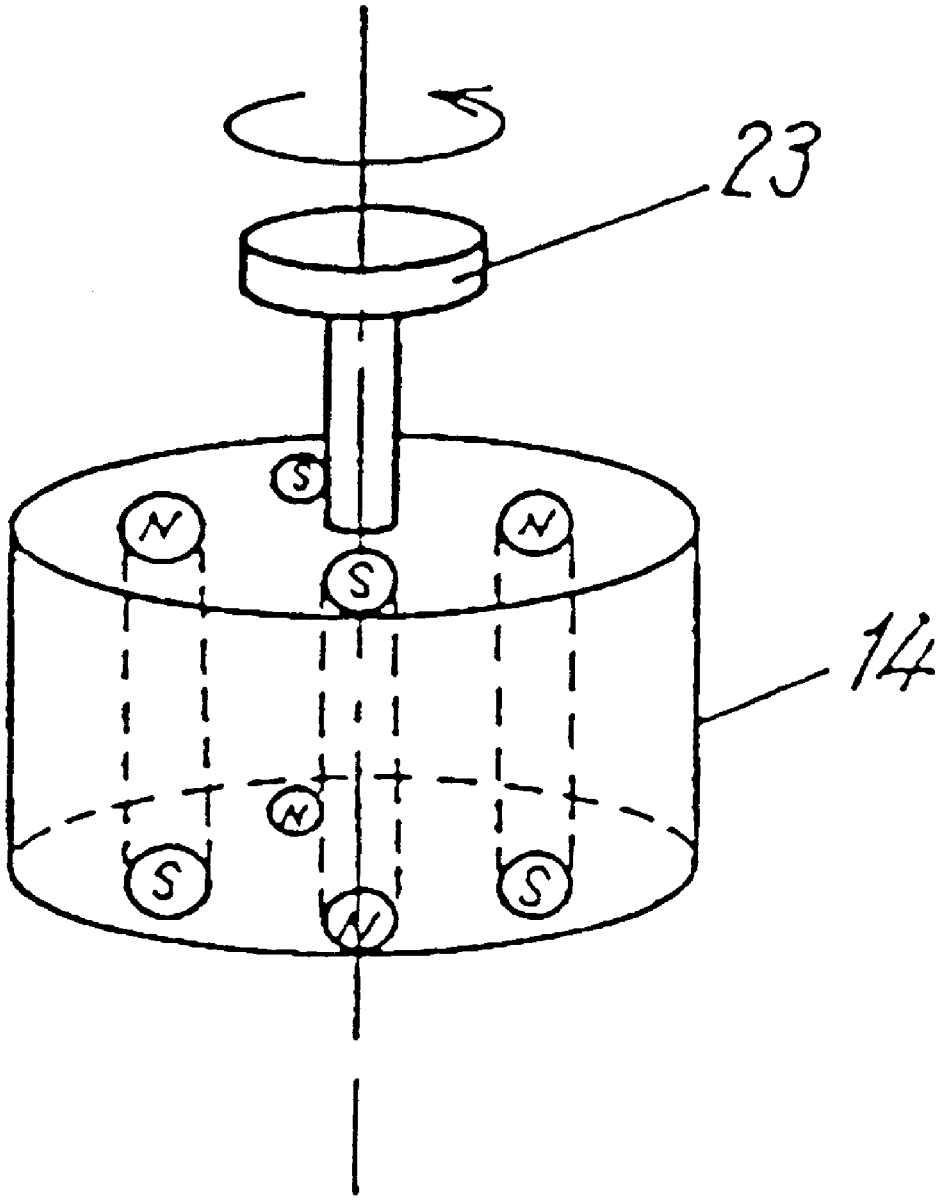
FIG. 9 is a perspective view showing a magnet in another embodiment of the present invention.
Figure 10:
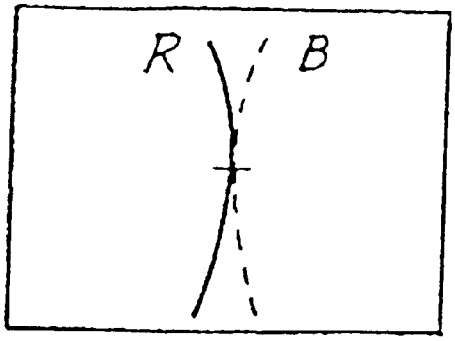
FIG .10 PRIOR ART
FIG. 10 shows a YH pincushion-shaped residual mis-convergence pattern.
Figure 11:
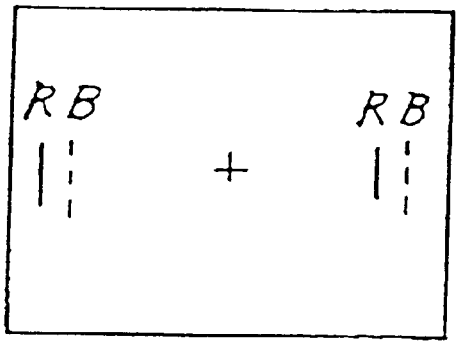
FIG .11 PRIOR ART
FIG. 11 shows an XH barrel-shaped residual mis-convergence pattern.
Figure 12:
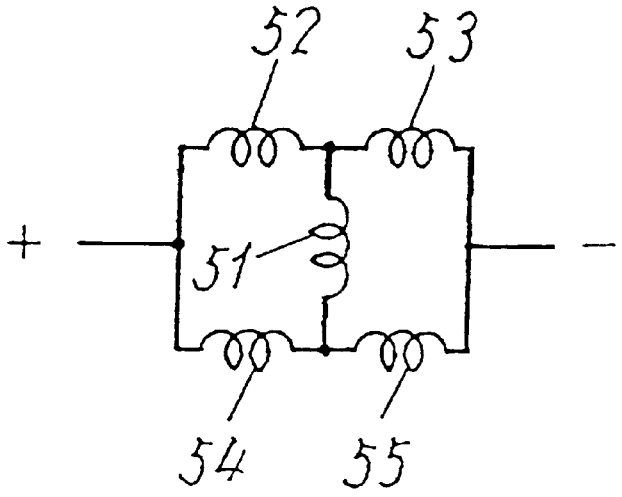
FIG .12 PRIOR ART
FIG. 12 is a diagram for describing a conventional XH correction circuit.
Figure 13:
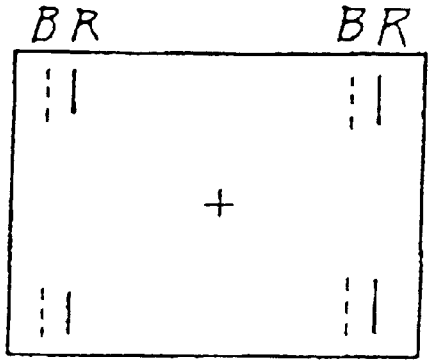
FIG .13 PRIOR ART
FIG. 13 shows a PQH red beam right pattern.

FIG. 9 is a perspective view of the magnet 14. The substantially cylindrical magnet 14 is polarised so that the south pole and the north pole are arranged alternately at a 90° interval around the central axis. A tab axis 23 is provided for rotating the magnet around the central axis. By rotating this, the strength of magnetic bias applied to the reactor coils 1 and 2 shown in FIG. 2 can be changed. This enables the fine adjustment of the XH correction amount.

As described above, in accordance with the present invention, even in a flat panel color display tube, which is likely to cause deterioration of various performances such as distortion, convergence and focus, it is possible to maintain those performances at a high level by using relatively simple means including a saturable reactor and four-pole coils, thus obtaining a color display tube with an excellent total quality.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color display tube device comprising:

a composite correction circuit having a series circuit of a first reactor coil and a first four-pole coil and a series circuit of a second reactor coil with a polarity opposite to that of the first reactor coil and a second four-pole coil, the two series circuits being connected in parallel; and a vertical control coil for applying a magnetic bias that changes in synchronization with a vertical deflection current to the first and second reactor coils, wherein the composite correction circuit is connected in series to horizontal deflection coils.

2. The color display tube device according to claim 1, further comprising a magnet for applying a constant magnetic bias to the first and second reactor coils, the first and second reactor coils, the vertical control coil and the magnet constituting a saturable reactor, wherein during a positive half cycle of a horizontal deflection current, the first reactor coil is saturated so that a four-pole magnetic field generated by the first four-pole coil becomes dominant, and during a negative half cycle of the horizontal deflection current, the second reactor coil is saturated so that a four-pole magnetic field generated by the second four-pole coil becomes dominant.

3. A color display tube device comprising:

a composite correction circuit having a series circuit of a first reactor coil and a first four-pole coil and a series circuit of a second reactor coil with a polarity opposite to that of the first reactor coil and a second four-pole coil, the two circuits being connected in parallel;

a vertical control coil for applying a magnetic bias that changes in synchronization with a vertical deflection current to the first and second reactor coils; and a magnet for applying a constant magnetic bias to the first and second reactor coils;

wherein the composite correction circuit is connected in series to horizontal deflection coils;

the first and second reactor coils, the vertical control coil and the magnet constitute a saturable reactor, during a positive half cycle of a horizontal deflection current, the first reactor coil is saturated so that a four-pole magnetic field generated by the first four-pole coil becomes dominant, during a negative half cycle of the horizontal deflection current, the second reactor coil is saturated so that a four-pole magnetic field generated by the second four-pole coil becomes dominant, thereby changing an amount of a vertical line mis-convergence between side beams on a horizontal axis in a screen so as to obtain a desired convergence, and a positively rectified vertical deflection current is supplied to the vertical control coil, so that a strength of the four-pole magnetic fields generated by the first and second four-pole coils is changed in synchronization with the current, and an amount of a vertical line mis-convergence between side beams at corners of a screen is changed, thereby obtaining a desired convergence independently from an amount of change of the vertical line mis-convergence between side beams on the horizontal axis in the screen, as well as correcting pincushion distortion in left and right parts of the screen.

4. The color display tube device according to claim 3, wherein magnetic flux density of the magnet of the saturable reactor is variable structurally, making it possible to perform a fine adjustment of a correction amount of the vertical line mis-convergence between side beams on the horizontal axis in the screen.

* * * * *